US006652951B2

(12) United States Patent
Gautreau

(10) Patent No.: US 6,652,951 B2
(45) Date of Patent: Nov. 25, 2003

(54) SCRIM OF SMALL THICKNESS

(75) Inventor: Thierry Gautreau, Cremieu (FR)

(73) Assignee: Chavanoz Industrie (FR)

( * ) Notice: Subject to any disclaimer, the term of this patent is extended or adjusted under 35 U.S.C. 154(b) by 0 days.

(21) Appl. No.: 09/737,499

(22) Filed: Dec. 15, 2000

(65) Prior Publication Data

US 2001/0018106 A1 Aug. 30, 2001

(30) Foreign Application Priority Data

Dec. 17, 1999 (FR) ..... 99 16002

(51) Int. Cl.[7] ..... B32B 5/12; B32B 27/04; B32B 27/12

(52) U.S. Cl. ..... 428/105; 428/113; 428/114; 428/119; 428/195; 428/198; 442/50; 442/54; 442/57; 442/58; 442/149; 442/206

(58) Field of Search ..... 442/50, 51, 52, 442/53, 54, 55, 56, 57, 58, 205, 206, 149; 428/105, 113, 114, 119, 198, 195

(56) References Cited

U.S. PATENT DOCUMENTS 3,949,111 A 4/1976 Pelletier ..... 428/109
5,232,533 A 8/1993 Tani et al. ..... 156/81
6,054,205 A * 4/2000 Newman et al. ..... 156/181
6,231,931 B1 * 5/2001 Blazey et al. ..... 427/358

FOREIGN PATENT DOCUMENTS

| | | |
|---|---|---|
| EP | 0 205 276 | 12/1986 |
| GB | 1 463 969 | 2/1977 |

* cited by examiner

*Primary Examiner*—Ula Ruddock
(74) *Attorney, Agent, or Firm*—Lerner, David, Littenberg, Krumholz & Mentlik, LLP

(57) ABSTRACT

A scrim is provided including a pair of sheets of non-woven warp threads separated by a sheet of non-woven crossed weft threads in which the warp threads and the crossed weft threads include cross point where they cross each other, and a binder binding the warp and weft threads together at the cross points creating adhesive points therebetween, the scrim having a performance ratio, TP, of greater than 30, the performance ratio represented by the formula $$TP = \frac{S}{T \times E \times C} \times 100$$

in which S is the surface area of the adhesive points in $mm^2$, T is the fineness of the warp and weft threads in g/km, E is the mean thickness of the scrim in mm, and C is the fraction of the adhesive binder in the scrim from 0 to 1.

10 Claims, 1 Drawing Sheet

SCRIM OF SMALL THICKNESS

FIELD OF THE INVENTION

The present invention generally relates to the field of scrim made up of a grid of warp threads and weft threads held in place by adhesive at the cross-points of the threads, said scrim being used in particular as reinforcement or support in various industrial applications.

The present invention more particularly relates to scrim formed by a grid of non-woven crossed or superposed threads, comprising at least two sheets of warp threads between which at least one sheet of weft threads is interposed, the warp and weft threads being bonded together at their cross-points by a binder creating a series of points of adhesive.

The present invention also relates to an industrial product, whether finished or otherwise, that incorporates therein scrim of the present invention.

The present invention also relates to a method of manufacturing scrim in which a grid of non-woven crossed or superposed threads is made comprising at least two sheets of warp threads between which at least one sheet of weft threads is interposed, and the grid of threads is coated in a binder to connect the warp and weft threads together.

BACKGROUND OF THE INVENTION

It is known to make scrim, industrially that comprises a grid of non-woven crossed threads with the threads being stuck together at their cross-points by being impregnated with a binder, such as a thermoplastic adhesive, or the like. Known scrim such as that illustrated by way of example in FIG. 1 has at least two sheets of warp threads, A and B, that are superposed or offset, with each pair of sheets, A and B, having at least one sheet C of weft threads interposed therebetween. In those known embodiments, the warp threads 1 and the weft threads 2 are connected together at their cross-points 3 by a binder 4 creating a series of points of adhesive so as to obtain scrim presenting a structure that is finished and stable, mechanically speaking.

Scrim made using this technique generally provides satisfaction, and can be used as reinforcement or support in a wide variety of technical fields, for example such as in the building industry, as a support or backing for floors and ceramics or for wall coverings and fitted carpets, in the paper-making industry, or as a reinforcing element in synthetic or other foams.

Nevertheless, it has been found that presently known scrim suffers from certain drawbacks, and in particular a drawback associated with the relatively great and usually very irregular thickness of the scrim. The methods of manufacturing known scrim require mere coating using an adhesive or a thermoplastic binder of the PVC or PVA type, for example, without any other operation. As a result the scrim that is obtained is relatively thick regardless of its nature, its type, or the number of threads used, and this leads to the resulting scrim being relatively inflexible. In addition, the thickness of known scrim is particularly irregular because of the existence of portions in relief at the cross-points between the warp threads 1 and the weft threads 2. The presence of such irregularities in prior art scrim clearly gives rise to various drawbacks, industrially speaking, particularly for certain specific applications.

Furthermore, it has been found that conventional scrim presents a certain amount of weakness in the grid of threads stuck together at the cross-points between the warp threads and the weft threads.

Finally, prior art scrim consumes a relatively large amount of adhesive or thermoplastic binder, particularly if it is desired to attempt to reinforce the mechanical strength of the grid of threads at the cross-points. This leads to an increase in the cost of the resulting product, which constitutes a drawback, industrially speaking.

In an attempt to remedy at least some of these drawbacks, proposals have been made, such as in British Patent No. 1,463,969, to make thin scrim in which the grid of threads is redistributed by compression, in particular by calendaring the scrim in order to flatten it. The resulting calendared scrim does indeed possess a reduced thickness, e.g. by about 200 micrometers ($\mu$m) to 150 $\mu$m, compared with conventional scrim. However, such a reduction in the thickness of scrim by calendaring is accompanied by partial destruction of the structure of the points of adhesive between the warp and weft threads, such that the mechanical breaking strength of these points is greatly reduced compared with conventional scrim. Furthermore, the technique of compressing scrim by calendaring is not accompanied by a reduction in the quantity of adhesive used. In all, calendared scrim, apart from being relatively complex and difficult to obtain on an industrial scale, suffers from various drawbacks making its use limited or even inappropriate in some applications.

Consequently, one object of the present invention is to remedy the various above-mentioned drawbacks of prior art scrim and to provide novel scrim comprising a grid of non-oven crossed or superposed threads, the scrim having a thickness that is generally reduced and regular, and also presenting good mechanical strength while being of low manufacturing cost.

Another object of the present invention is to provide a novel scrim presenting general performance characteristics that are particularly high with respect to mechanical strength, flexibility, and bulk.

Another object of the present invention is to provide a novel scrim of a thickness that is particularly small and regular.

Another object of the present invention is to provide a novel industrial product incorporating scrim of the present invention.

An additional object of the present invention is to provide a novel method of manufacturing scrim comprising a grid of non-woven crossed or superposed threads that is particularly simple to implement.

SUMMARY OF THE INVENTION

In accordance with the present invention, these and other objects have now been realized by the invention of a scrim comprising a first sheet of non-woven warp threads, a second sheet of non-woven warp threads, and a third sheet of non-woven crossed weft threads interposed between the first and second sheets of non-woven warp threads, whereby the warp threads and the crossed weft threads include cross points where the warp and weft threads cross each other, and a binder binding together the warp and weft threads at the cross points thereby creating a plurality of adhesive points therebetween, the scrim having a performance ratio, TP, of greater than 30, the performance ratio represented by the formula $$TP = \frac{S}{T \times E \times C} \times 100$$

wherein S comprises the surface area of the adhesive points in $mm^2$, T comprises the fineness of the warp and weft threads in g/km, E comprises the mean thickness of the scrim in mm, and C comprises the fraction of the adhesive binder in the scrim from 0 to 1. Preferably the performance ratio, TP, is from 45 to 120.

In accordance with one embodiment of the scrim of the present invention, the mean thickness, E, of the scrim is substantially regular across the entire surface of the scrim. Preferably, the mean thickness, E, is less than 0.175 mm, more preferably less than 0.150 mm, and most preferably from 0.150 to 0.06 mm.

In accordance with another embodiment of the scrim of the present invention, the fraction of the adhesive binder in the scrim, C, is less than 0.35.

In accordance with another embodiment of the scrim of the present invention, the warp and weft threads comprise glass threads. Preferably, the glass threads have a fineness, T, of from 5.5 to 136 g/km.

In accordance with another embodiment of the scrim of the present invention, the adhesive binder comprises a thermoplastic adhesive.

In accordance with another embodiment of the scrim of the present invention, the scrim is attached to a woven or non-woven fabric.

In accordance with the present invention, a method of manufacturing the scrim is provided comprising producing a grid of non-woven warp and weft threads by applying a first sheet of non-woven warp threads, applying a third sheet of non-woven crossed weft threads thereon, and applying a second sheet of non-woven warp threads thereon, whereby the warp threads and the crossed weft threads include cross points where the warp and weft threads cross each other, impregnating the grid with an adhesive binder for binding the warp and weft threads together at the cross points, and pressing the grid including the adhesive binder before the adhesive binder has concluded drying. Preferably, the pressing of the grid occurs at least partially simultaneously with the drying of the adhesive binder.

In accordance with the present invention, a laminated industrial product has been provided in combination with the scrim set forth above.

The objects of the present invention are achieved by means of scrim formed by a grid of non-woven crossed threads comprising:

at least two sheets of warp threads between which at least one sheet of weft threads is interposed, the warp and weft threads being bonded together at their cross-points by means of a binder that creates a series of adhesive points, wherein the scrim has a performance ratio TP greater than 30, where the performance ratio is calculated using the following formula:

$$TP = \frac{S}{T \times E \times C} \times 100$$

in which:

S=the surface area of the points of adhesive in $mm^2$;

T=the fineness of the warp and weft threads in grams per kilometer (g/km);

E=the mean thickness of the scrim in mm; and

C=the adhesive fraction in the range 0 to 1.

The objects of the present invention are also achieved by means of a method of manufacturing scrim of the present invention, which comprises:

making a grid of non-woven crossed or superposed threads comprising at least two sheets of warp threads between which at least one sheet of weft threads is interposed; and impregnating the grid of threads with a binder for binding the warp and weft threads together at their cross-points, wherein the grid of threads is pressed before the stage of drying the binder has terminated.

BRIEF DESCRIPTION OF THE DRAWINGS

Other particular objects and advantages of the invention will become apparent by considering the following detailed description, and from the accompanying drawing, given purely by way of non-limiting illustration and in which.

DETAILED DESCRIPTION

Figure 1:
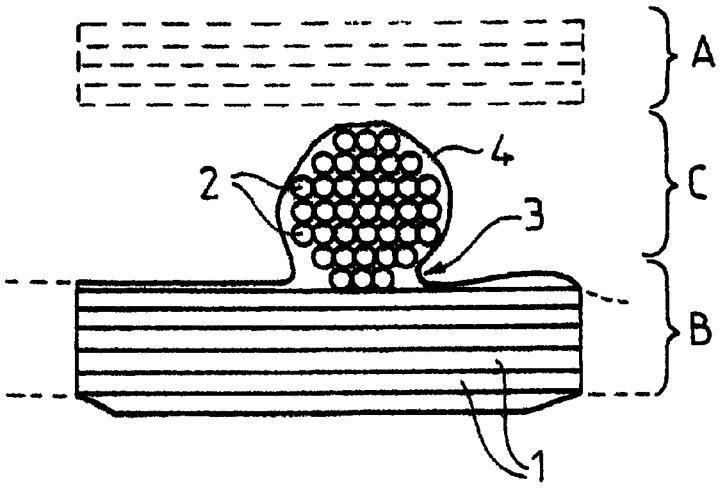
FIG. 1 is a side, elevational, fragmentary sectional view showing a structural detail of prior art scrim.
Figure 2:
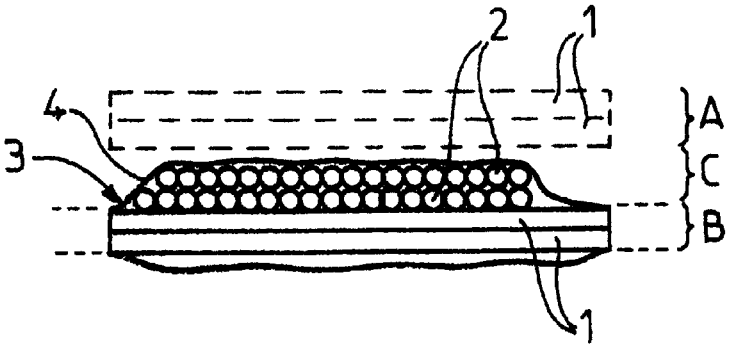
FIG. 2 is a side, elevational, fragmentary cross-sectional view showing structural details of scrim of the present invention.

In the present invention, and as shown in FIG. 2, scrim is formed by a grid of non-woven crossed or superposed threads comprising at least two sheets, A and B, of warp threads 1 having at least one sheet C of weft threads 2 interposed between them.

As is well known to the person skilled in the art, the grid of warp and weft threads, 1 and 2, is obtained while offsetting the warp and weft threads so that they are not superposed, or on the contrary by ensuring that they are superposed. Similarly, the grid of warp and weft threads, 1 and 2, can be obtained with the warp and weft threads crossing at 90° (square construction) or at some other angular inclination, and for example in a three-directional configuration.

By way of a non-limiting example, the scrim of the present invention can be formed with various numbers of threads, which for the warp threads can lie in the range of from 0.5 threads per centimeter to 8 threads per centimeter, and for the weft threads can lie in the range, for example, of from 0.5 threads per centimeter to 5 threads per centimeter.

By way of non-limiting example, and as is well known to the person skilled in the art, any type of textile thread commonly used for making scrim can be used, for example threads of the Silionne, polyester, cellulose, aramid, or polyamide type.

In the present invention, the warp threads 1 and the weft threads 2 are bonded together at their cross-points 3 by a binder 4 that creates a series of points of adhesion at the intersections in the grid of threads.

In accordance with the present invention, any binder or adhesive commonly presently used in the technical field in question can be used, and in particular any binder or thermoplastic adhesive. By way of non-limiting examples, the bonding and coating of the grid of threads forming the scrim of the present invention can comprise synthetic latexes (SBR,), polyvinyl acetate (PVAC), polyvinyl chloride (PVC) plastisols, polyvinyl alcohol (PVA), conventional thermo-adhesive impregnation, polyurethane binders, or acrylic binders, for example.

In accordance with the present invention, it has been found that remarkable characteristics can be obtained in the behavior of the scrim, providing that the structural characteristics of the grid of threads making up the scrim of the present invention such as the area of the points of adhesive, and the mean thickness of the scrim and the amount of adhesive used or present in the mass of threads, are maintained above certain minimum values that take into account the fineness of the warp and weft threads used.

The structural characteristics of scrim of the present invention can thus be expressed as a performance ratio TP greater than 30, where the performance ratio is calculated in application of the following formula:

$$TP = \frac{S}{T \times E \times C} \times 100$$

in which:

S=the surface area of the points of adhesive, in $mm^2$;

T=the fineness of the warp and weft threads, in grams per kilometer (g/km);

E=the mean thickness of the scrim, in mm; and

C=the adhesive fraction in the range 0 to 1.

Scrim characterized in this manner has a small thickness, e.g. preferably less than 0.175 mm thick, and it is regular without significant portions in relief existing at the cross-points between the warp threads 1 and the weft threads 2, while still providing excellent mechanical strength to the grid of threads, and with adhesive consumption being at least 30% less than that of conventional scrim.

Thus, at the cross-points, the thickness of the scrim is substantially equal to twice the thickness of the thread away from the cross-points.

As a subsidiary point, the resulting scrim is flexible and of small bulk since compared with known conventional scrim, so the length that can be wound into a roll of given size can be doubled with scrim of the invention.

The general characteristics of the behavior of scrim of the present invention are particularly improved when the performance ratio TP lies in the range of from 45 to 120.

Similarly, in the present invention, thickness, E, is preferably less than 0.150 mm, and more preferably lies in the range of from 0.150 mm to 0.06 mm.

The value of T is obtained by taking the average of the finenesses of the warp threads and the weft threads used, as follows:

$$\frac{\text{warp fineness} + \text{weft fineness}}{2}$$

Table 1 below compares measured values that are characteristic of a fine scrim of the present invention and normal prior art scrim, both having the same composition in terms of grid threads and thermoplastic binder, and for six different compositions of grid threads.

TABLE 1

| | | PRIOR ART SCRIM | | | | SCRIM OF THE INVENTION | | | |
|---|---|---|---|---|---|---|---|---|---|
| Scrim | Thread fineness in g/km | Thickness in mm | Adhesive fraction | Adhesive point area in $mm^2$ | Performance ratio TP | Thickness in mm | Adhesive fraction | Adhesive point area in $mm^2$ | Performance ratio TP |
| Grid: 68 tex Silionne warp and weft, EVA adhesive | 68 | 0.2 | 0.15 | 0.16 | 8 | 0.1 | 0.14 | 0.5 | 53 |
| Grid: 80 dtex PES (polyester) warp and weft, EVA adhesive | 8 | 0.096 | 0.38 | 0.02 | 7 | 0.063 | 0.31 | 0.09 | 58 |
| Grid: 1100 dtex PES warp and weft, EVA adhesive | 110 | 0.24 | 0.28 | 1.23 | 17 | 0.175 | 0.11 | 2.6 | 123 |
| Grid: 1100 dtex PES warp and weft, PVC impregnation | 110 | 0.265 | 0.42 | 2.45 | 20 | 0.17 | 0.31 | 3.5 | 60 |
| Grid: 34 tex Silionne warp and weft, EVA adhesive | 34 | 0.15 | 0.22 | 0.085 | 8 | 0.08 | 0.14 | 0.17 | 45 |
| Grid: 80 dtex PES waft and weft, PVC impregnation | 8 | 0.1 | 0.53 | 0.028 | 7 | 0.06 | 0.33 | 0.09 | 57 |

The six embodiments shown in Table 1 compare scrim made of identical warp and weft threads of identical fineness, it being understood that in accordance with the present invention, the grid of warp and weft threads in any one grid can be made using different kinds of thread and threads of different fineness without thereby going beyond the size of the present invention. Under such circumstances, the performance ratio of the scrim of the present invention is calculated by taking the statistical mean of the finenesses of the warp and weft threads.

It can thus be seen that prior art scrim, when compared with scrim of the present invention, has smaller adhesive point areas, a larger adhesive fraction, and a thickness that is also larger.

In particular, the adhesive fraction of scrim of the present invention is less than 0.35.

In general, prior art scrim made with warp and weft threads made up of 68 tex glass threads with an EVA (ethylvinylacetate) thermoplastic binder (adhesive fraction 20% to 30%) present a breaking strength of less than 0.55 Newtons (N), whereas the breaking strength of scrim having the same composition and made in accordance with the present invention, having an adhesive fraction reduced to about 12% to 15%, is close to 0.95 N.

Scrim of the present invention makes it possible to use glass threads in which the fineness of the warp and weft threads lies in the range of from 5.5 g/km to 136 g/km, while obtaining the advantageous effects of the present invention.

The method of measurement used for calculating the area of adhesive points expressed in square millimeters was performed by measuring the area of overlap between a warp thread 1 and a weft thread, and by taking the average of ten different measurement points.

The method used for determining the mass per unit length or fineness of the thread was in compliance with French standard NF G07-317 (ISO 2060 of June 1995) for threads other than glass and carbon threads. For glass and carbon threads, the mass per unit length expressed in g/km was determined by the application of standard T25-020 (ISO 1889 of August 1997).

The thickness of the scrim was measured by the application of standard NF G37-102.

The adhesive fraction in the range 0 to 1 is given by the following relationship:

$$\text{adhesive fraction} = 1 - \frac{\text{mass of scrim in g/m}^2}{\text{mass of threads per m}^2}$$

Such measurement was performed on the basis of standard NF T57-511.

In accordance with the present invention, the method of manufacturing scrim and as described above makes use of a series of conventional fabrication steps well known to the person skilled in the art using conventional fabrication parameters adapted to the nature and the fineness of the warp and weft threads used, and to the nature and the fraction of the adhesive employed.

Thus, the method of manufacture implements a general step of building the grid of threads, followed by a step of impregnating with adhesive and determining an appropriate fraction, followed by a step of drying the resulting scrim.

Apparatus for producing such articles is described in numerous patents, and in particular in French Patent Nos. 1,391,900 and 2,067,607. Such apparatus essentially comprises a rotary element, commonly referred to as a "flyer," which distributes one or more weft threads around two rotary thread support elements that are spaced apart from each other so as to form between these elements a series of spaced-apart loops that form a weft sheet. In such apparatus, the shaft supporting the flier is hollow and at least one of the weft threads is fed to the flier by passing inside that shaft. The rotation of the support elements causes the weft thread to advance laterally, with the loops of thread forming the sheet remaining parallel to one another. This moving weft sheet is then assembled by adhesion with one or more sheets of warp threads which are fed in coplanar relationships adjacent thereto by means of suitable guides.

Thus, the method of fabricating scrim of the present invention is a method comprising the steps of:

making a grid of non-woven crossed or superposed threads comprising at least two sheets of warp threads between which at least one sheet of weft threads is interposed; and impregnating the grid of threads with a binder for binding the warp and weft threads together at their cross-points.

The special feature of the method of the present invention lies in the fact of pressing the grid of warp and weft threads before the step of drying the binder has terminated, i.e. while the adhesive is still in a substantially or completely liquid or fluid state.

Advantageously, the grid of threads is pressed at least in part simultaneously with the stage of drying the binder.

The method can be implemented industrially and continuously using conventional elements involving reels, presser elements, and drying elements including a series of cylinders.

The scrim of the present invention can be used directly in various conventional applications such as those mentioned above, in particular as reinforcing or stabilizing elements. In addition, the scrim of the present invention can also be used and incorporated in some other element to form an industrial product incorporating scrim of the present invention.

In particular, the scrim of the present invention can be stuck or backed onto a woven or non-woven fabric such as a web to form a "laminated" industrial product. In such an application, the structural characteristics to be taken into consideration when making the scrim are identical to those for scrim on its own, the thickness E of the laminated scrim being the thickness of the scrim itself, and equal to the thickness of the laminate minus the thickness of the non-woven element.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A scrim comprising a first sheet of non-woven warp threads, a second sheet of non-woven warp threads, and a third sheet of non-woven crossed weft threads interposed between said first and second sheets of non-woven warp threads, wherein said warp threads and said crossed weft threads include cross points where said warp and weft threads cross each other, and a binder binding together said warp and weft threads at said cross points thereby creating a plurality of adhesive points therebetween, said scrim having a performance ratio, TP, of greater than 30, said performance ratio represented by the formula $$TP = \frac{S}{T \times E \times C} \times 100$$

Wherein S comprises the surface area of said adhesive points in $mm^2$, T comprises the fineness of said warp and weft threads in g/km, E comprises the mean thickness of said scrim in mm, and comprises the fraction of said adhesive binder in said scrim from greater than 0 to 1, said mean thickness E being substantially regular across the entire surface of said scrim.

2. The scrim of claim 1 wherein said performance ratio, TP, is from 45 to 120.

3. The scrim of claim 1 wherein said mean thickness, E, is less than 0.175 mm.

4.The scrim of claim 3 wherein said mean thickness, E, is less than 0.150 mm.

5. The scrim of claim 4 wherein said mean thickness, E, is from 0.150 to 0.06 mm.

6. The scrim of claim 1 wherein said fraction of said adhesive binder in said scrim, C, is less than 0.35.

7. The scrim of claim 1 wherein said warp and weft threads comprise glass threads.

8. The scrim of claim 7 wherein said glass threads have a fineness, T, of from 5.5 to 136 g/km.

9. The scrim of claim 1 wherein said adhesive binder comprises a thermoplastic adhesive.

10. The scrim of claim 1 attached to a woven or non-woven fabric.

* * * * *